US006547517B1

(12) United States Patent
Peter-Fenner et al.

(10) Patent No.: US 6,547,517 B1
(45) Date of Patent: Apr. 15, 2003

(54) FLUID IMPELLER

(75) Inventors: David Peter-Fenner, Southhampton (GB); Christopher Winston Lack, Weybridge (GB)

(73) Assignee: Elta Fans Limited, Segensworth (GB)

( * ) Notice: Subject to any disclaimer, the term of this patent is extended or adjusted under 35 U.S.C. 154(b) by 0 days.

(21) Appl. No.: 09/011,434

(22) PCT Filed: Aug. 9, 1996

(86) PCT No.: PCT/GB96/01965

§ 371 (c)(1),
(2), (4) Date: Aug. 2, 2000

(87) PCT Pub. No.: WO97/06369

PCT Pub. Date: Feb. 20, 1997

(30) Foreign Application Priority Data

Aug. 10, 1995 (GB) ..... 9516398

(51) Int. Cl.[7] ..... F03B 3/06
(52) U.S. Cl. ..... 415/130; 415/141
(58) Field of Search ..... 416/189, 131; 415/130, 140, 141

(56) References Cited

U.S. PATENT DOCUMENTS

| | | | | | |
|---|---|---|---|---|---|
| 1,822,778 A | * | 9/1931 | Kaplan | ..... | 415/129 |
| 2,382,535 A | | 8/1945 | Bauer | ..... | 230/114 |
| 2,947,466 A | * | 8/1960 | Busquet | ..... | 415/129 |
| 4,599,041 A | | 7/1986 | Stricker | ..... | 415/130 |

FOREIGN PATENT DOCUMENTS

| | | | | |
|---|---|---|---|---|
| DE | 949 899 | 9/1956 | | |
| DE | 31 28 654 | 8/1982 | ..... | F04D/17/06 |
| EP | 0 187 940 | 7/1986 | ..... | F04D/29/34 |
| GB | 1174591 | 12/1969 | ..... | F04D/15/00 |

* cited by examiner

*Primary Examiner*—Edward K. Look
*Assistant Examiner*—Richard A. Edgar
(74) *Attorney, Agent, or Firm*—Andy Arismendi, Jr.

(57) ABSTRACT

A fluid impeller, such as a fan for moving air or gases, includes one or more rotatable fluid impelling blades; a flow guiding member adjacent to an edge of the blades, and at least one blade facing surface of the flow guiding member being formed substantially as a segment of a sphere of radius $r_1$ about a center of curvature. Each blade has a flow guiding member abutting edge curved substantially to fit against a sphere of radius $r_1$.

10 Claims, 3 Drawing Sheets

FLUID IMPELLER

CROSS-REFERENCE TO RELATED APPLICATIONS

This application claims priority from PCT/GB96/01965, filed Aug. 9, 1996 which in turn claims priority from GB 9516398 filed Aug. 10, 1995.

FIELD OF THE INVENTION

The present invention relates to fluid impellers used with mixed flow fans such as fans for moving air or other gases.

BACKGROUND OF THE INVENTION

Various motor-driven fan configurations have been proposed to meet respective different requirements for performance, noise generation, and cost, etc. A better understanding of these motor-driven fan configurations may be obtained from the following description which references FIGS. 1 through 7.

FIGS. 1 and 2 show schematic end and cut-away side views respectively of an axial flow fan blade assembly. The impeller includes a number of aerofoil blades 10 fixedly mounted to a central hub 20, which is generally enclosed within a stationary cowling 30. The impeller is driven by a motor 40, and air is driven by the impeller in a direction 50 which is substantially along the axis of rotation of the fan blade assembly.

Axial flow fans provide large volume flow rates of air, but operate at relatively low pressures. As the pressure increases, the fan is liable to stall.

FIGS. 3 and 4 of the accompanying drawings show schematic end and cut-away side views of a prior art centrifugal fan. This type of fan comprises blades 60 fixedly mounted to a rotating hub 70 driven by a motor 80. The centrifugal fan has a casing 90 which allows air to enter generally along the axis of rotation of the blade assembly but to exit perpendicular to the entry direction.

In the centrifugal fan, air is forced to rotate by movement of the blades 60 and is flung outwards towards the exit port 100 by the centrifugal effect. Centrifugal fans are recognized for their low volume flow rates of air but high pressure performance, generally without the stalling problems exhibited by axial flow fans. However, centrifugal fans are generally not suitable for use with large volume flow rates.

The so-called mix flow fan was developed as a compromise between the axial and centrifugal fan assemblies. It is designed to operate at generally higher pressures than an axial flow fan, but to provide a generally greater volume flow rate than a centrifugal fan. FIGS. 5 and 6 are schematic and cut-away side views respectively of a prior art mixed flow fan.

The mixed flow fan comprises a number of blades 110 attached to a central frusto-conical hub 120 and to a generally frusto-conical shroud 130. The blades 110, hub 120, and frusto-conical shroud 130 form a complete rotating assembly, driven by a motor 140.

In operation, the fan behaves as a combination of the axial and centrifugal flow devices, so that air entering the shroud 130 is drawn into the impeller, with a velocity component along the axis of rotation, but the air is also driven outwardly in a similar manner to the centrifugal fan, with a velocity component perpendicular to the axis of rotation. These two velocity components combine to give an output direction 150 as illustrated in FIG. 6.

FIG. 7 is a typical pressure-volume flow rate performance graph comparing the performance of the prior art fans shown in FIGS. 1 through 6.

In FIG. 7, the first curve 160 illustrates the high-pressure, low volume performance of a centrifugal flow fan. The second curve 170 represents the high-volume, low-pressure operation of an axial flow fan. (The stalling characteristic of the axial flow fan is not shown on FIG. 7.) The third curve 180 shows the performance of a mixed flow fan which provides a generally higher volume but lower pressure performance in comparison to the centrifugal fan, and a higher pressure but lower volume performance in comparison to the axial flow fan.

Each of the performance curves shown schematically in FIG. 7 relates to a particular prior art fan configuration (fan diameter, number of blades and angle of blades) and rotation speed of the blade assembly. Once these fan characteristics have been set, the fan performance is generally fixed, so that, for example, if the operating pressure for the fan is specified, the resulting volume flow-rate which will be obtained is defined by the performance curve.

However, it is desirable in manufacturing and installing fans to be able to vary the performance of the fans. This allows a manufacturer to market a range of fans having different performance curves, but which share some or all of their components in common.

In the case of an axial flow fan, it is relatively easy to vary the fan's performance while still using the same mechanical components. For example, the blade angle of incidence can be varied to give dramatic changes in the performance characteristics. In one example, a change in the blade angle of incidence from, say, 10° to 40° could result in 2:1 change in volume flow rate (and a correspondingly large change in driving power consumption).

However, in the centrifugal and mixed flow fans described above, there is little room for changing the fan's performance. The number of blades can be varied, but this tends to give dramatic, rather than gradual, changes in performance. The motor speed can be varied, but this requires either a belt drive system, which adds to the mechanical complexity of the fan, or the use of different motors, such as two-pole, four-pole, six-pole motors, etc. However, since the rotation speed of a two-pole motor is twice that of a four-pole motor, this again leads to dramatic, rather than gradual, variations in the fan's performance.

In summary, none of the previously proposed fans described above provide relatively high pressure operation and still allow the fan performance to be easily varied.

SUMMARY OF THE INVENTION

This invention provides a mixed flow fan which provides relatively high pressure operation while still allowing the fan performance to be easily varied. Specifically, the fluid impeller of the fan of the present invention includes one or more rotatable fluid impelling blades and a hub adjacent to an edge of the blades. At least one blade facing surface on the hub is formed substantially as a segment of a sphere of radius $r_1$ about a center of curvature. Surrounding the blades is a shroud which is adjacent to an outer edge of each blade. At least one blade facing surface of the shroud is formed substantially as a segment of a sphere of radius $r_2$ about the center the curvature. Each blade has a hub abutting edge curve which substantially fits against a sphere of radius $r_1$ and a shroud abutting edge curved substantially to fit against a sphere of radius $r_2$ so that each blade is attachable to the hub and to the shroud at various angles about an axis passing through the center of curvature while the hub abutting and shroud abutting edges of the blade remain substantially abutting the hub and the shroud respectively.

BRIEF DESCRIPTION OF THE FIGURES

The embodiments of the invention will now be described, by way of example only, with reference to the accompanying drawings throughout which like parts are referred to by like reference numbers, and in which.

DETAILED DESCRIPTION OF THE EMBODIMENTS

Figure 8:
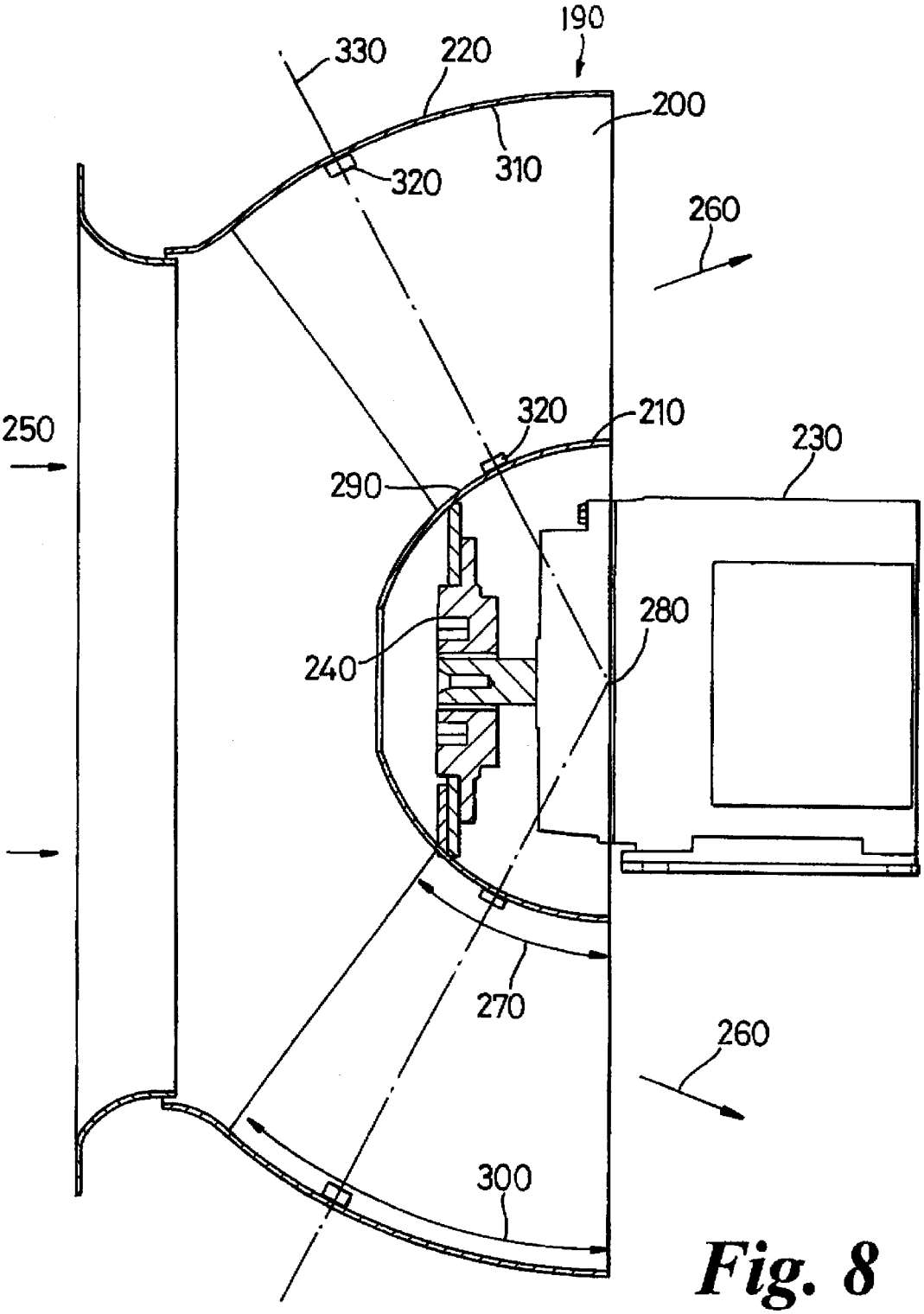
FIG. 8 is a schematic side view of a fan according to an embodiment of the invention; and, FIG. 9 is a schematic sectional side view of a fan blade for the fan of FIG. 8.

Referring now to FIG. 8, a fan according to the preferred embodiment of the invention comprises a number of blades 200 held between a rotating hub 210 and a rotating shroud 220, so that the hub 210, blades 200 and shroud 220 form a single rotating assembly 190. The single rotating assembly 190 is driven by a motor 230, coupled to the hub 210 via a bracket 240.

The fan operates similar to the mixed flow fan described above, so that air enters in a generally axial direction 250 at an entrance of the rotating shroud 220, and is driven axially and outwardly by the rotating blades 200 to emerge in an exit direction 260.

The blade angle can be easily adjusted in the fan shown in FIG. 8. This is because the hub 210, or at least that part 270 which contacts the blades 200, forms part of the surface of a sphere centered around a point 280. The edge 290 of each blade 200 which mates against the hub 210 is arranged to fit against the spherical surface of the hub 200. In this example, it is a segment of a circle centered on the point 280. The inner surface of the shroud 220, or at least the part 300 which contacts the blades 200, forms part of a sphere centered around the point 280. Finally, the outer edge 310 of each blade is again arranged to fit against the spherical surface of the shroud 220, and in this example forms a segment of a circle centered around the point 280.

In fact, at least a part of each of the hub 210 and the shroud 220 in this embodiment is frusto-spherical in shape.

Each blade is attached to the hub 210 and to the shroud 220 by pivotable attachment points 320, such as nut and bolt connections. The pivotable attachment points 320 are arranged so that for each blade, the two pivotable attachment points 320 (one on each end of the blade) lie on a single axis 330 centered on the point 280.

In order to explain how this arrangement allows the blades to be positioned at different blade angles, it is first noted that a circular disc of radius r can be positioned at any orientation within a sphere of inside radius r. Whatever the orientation of the disc within the sphere, however, the center of the disc will lie at the inside surface of the shroud 220 could be considered as part of the inside surface of the sphere referred to above. This means that the outer edge 310 of the blade 200 can be placed at any angle to the inside surface of the shroud 220, so long as the center of the curvature of the shroud 220 and the outer edge of the blade 200 remains at the common point 280. Accordingly, the blades 200 can be pivoted around the pivotable attachment points 320 at various angles, but the outer edge 310 of the blade 200 will remain in contact with the inner surface of the shroud 220.

This argument can easily be extended to show that the blade angle can be varied while the inner edge of each blade 200 remains in contact with the outer surface of the rotating hub 210.

Figure 1:
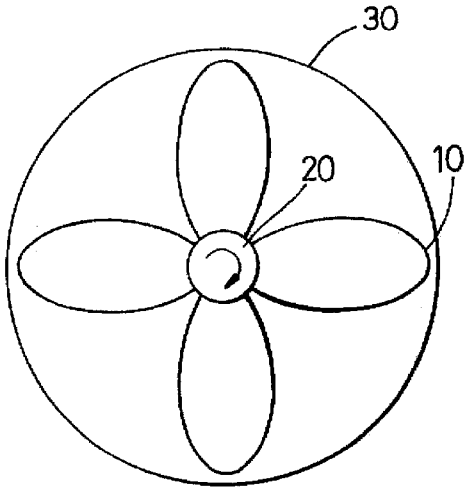
Fig. 1 (PRIOR ART)
FIG. 1 is a schematic end view of a prior art axial flow fan.
Figure 2:
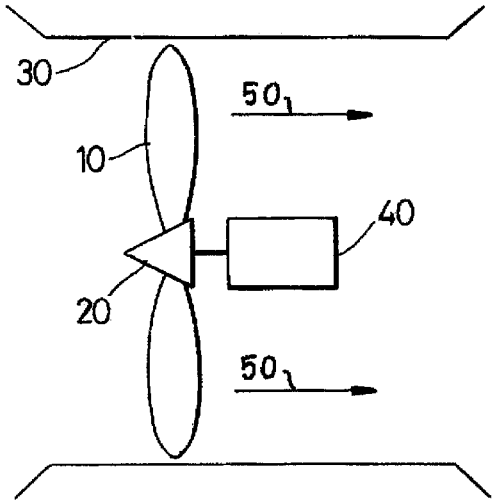
Fig. 2 (PRIOR ART)
FIG. 2 is a schematic cutaway side view of the fan of FIG. 1.
Figure 3:
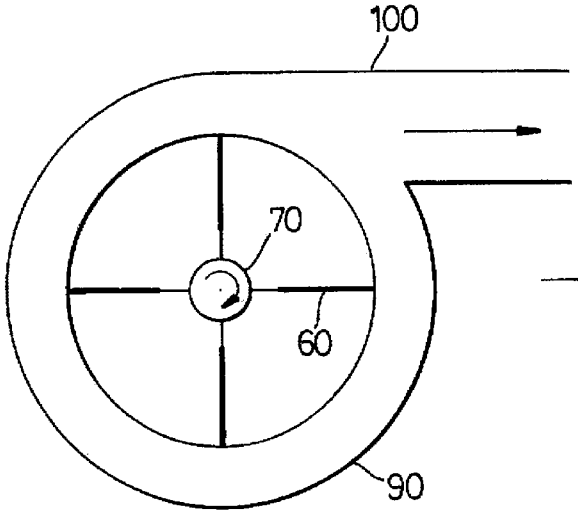
Fig. 3 (PRIOR ART)
FIG. 3 is a schematic end view of a prior art centrifugal fan.
Figure 4:
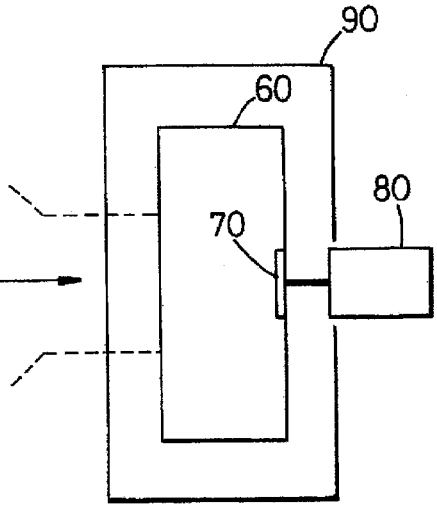
Fig. 4 (PRIOR ART)
FIG. 4 is a schematic cutaway side view of the fan of FIG. 3.
Figure 5:
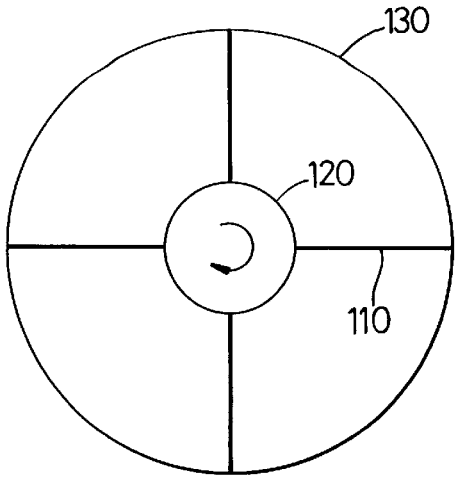
Fig. 5 (PRIOR ART)
FIG. 5 is a schematic end view of a prior art mixed flow fan.
Figure 6:
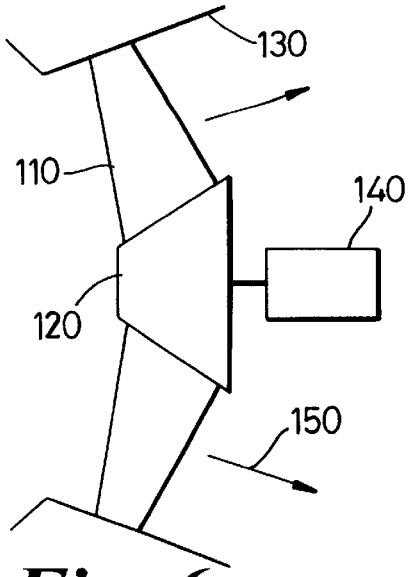
Fig. 6 (PRIOR ART)
FIG. 6 is a schematic cutaway side view of the fan of FIG. 5.
Figure 7:
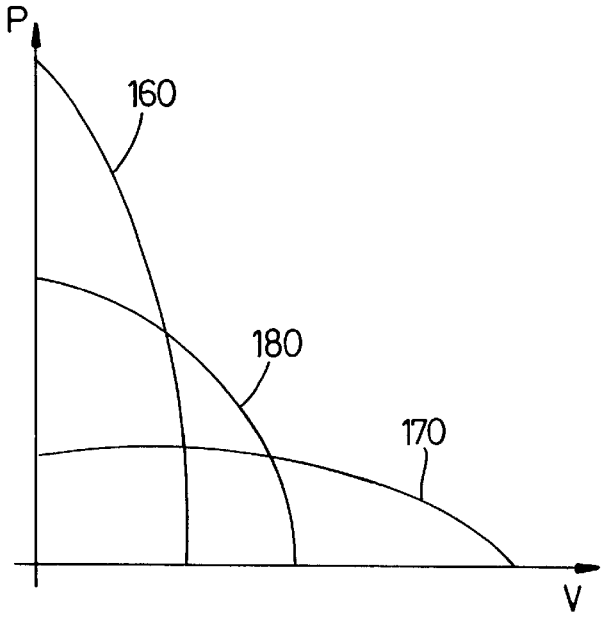
Fig. 7 (PRIOR ART)
FIG. 7 is a schematic pressure-volume performance graph for the prior art fans shown in FIGS. 1 through 6.
Figure 9:
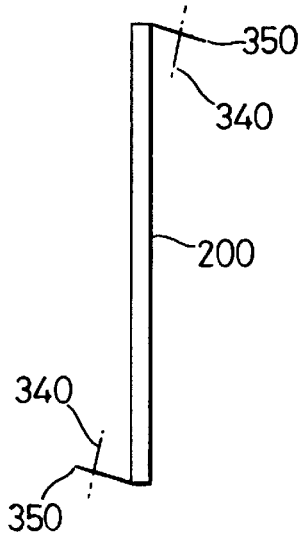

FIG. 9 is a schematic sectional side view of a fan blade 200 for the fan of FIG. 8.

Although the pivot points 320 about which each blade is pivotable for blade angle adjustment should lie on an axis 330 from the common central point 280, it is not in fact necessary for the pivot points to coincide with the part-circular edges of the blade 200. In fact, the blade 200 could pivot around displaced pivot points 340, (e.g., connected to the blades 200 by mounting plates 350). This allows easier access to the nut and bolt connection of the pivotable mounting.

The blade of FIG. 9 is shown having a flat cross-section, but it will be appreciated that the blade could be twisted to give an aero-dynamic shape using known design techniques.

The embodiment of FIG. 8 shows air which is driven by the fan emerging at the motor end of the fan. Similarly, the motor 230 need not be directly attached to the hub 210, but could drive via a belt or gear arrangement. Various different numbers of blades could be used, depending on the application of the fan.

The alternate embodiments of the mixed flow fan according to the invention, the performance, characteristics of a mixed flow fan can be obtained, while allowing the performance to be varied easily by changing the blade angle of incidence. Because the hub and/or shroud surfaces are based on segments or sections of spherical surfaces, a blade having a complementary shape at each end can be fixed at different angles between two surfaces.

For ease of adjustment of the fan characteristics, it is preferred that each blade is pivotable about their respective mounting points. In particular, it is also preferred that each blade is pivotable about a respective mounting point on the hub and on the shroud, the mounting points on the shroud and the hub lying substantially on the axis of curvature of the hub and the shroud.

Other possible modifications include the possibility that the blades need not be pivotally mounted with respect to the hub or the shroud. In fact, the blades could be fixed in place, e.g., by welding or brazing, at the time of manufacture. The advantage still remains, however, that the fan manufacturer can stock a single pattern of blade and use it to produce fans featuring a variety of blade angles.

While the fluid impeller of the present invention has been described by reference to its preferred and alternate embodiments, those of ordinary skill in the art will understand that still other embodiments are possible based on the embodiments described herein. Such other embodiments shall fall within the scope of the appended claims.

What is claimed is:

1. A mixed flow fan comprising:

one or more fluid impelling blades;

a hub adjacent to an edge of each of said one or more fluid impelling blades, at least one blade facing surface of said hub being formed substantially as a segment of a sphere of radius $r_1$ about a center of curvature;

a shroud adjacent to an outer edge of each of said one or more fluid impelling blades, at least one blade facing surface of the shroud being formed substantially as a segment of a sphere of radius $r_2$ about the center of the curvature;

wherein each of said one or more fluid impelling blades has a hub abutting edge curved substantially to fit against a sphere of radius $r_1$ and a shroud abutting edge curved substantially to fit against a sphere of radius $r_2$ so that each of said one or more fluid impelling blades is attachable to said hub and said shroud at various angles about an axis passing through the center of curvature, each angle of said various angles in use achieving a different performance and at each angle of said various angles said hub abutting and said shroud abutting edges of one or more fluid impelling blades remain substantially abutting said hub and said shroud respectively, said hub, said shroud and said blades forming a single rotatable assembly, each of said one or more fluid impelling blades is pivotable about a respective mounting point an said shroud, each of said one or more fluid impelling blades is pivotable about a respective mounting point on said hub, and the mounting points on said shroud and said hub lie substantially on an axis passing through the center of curvature of said hub and said shroud.

2. A mixed flow fan according to claim 1, in which at least part of said hub is frusto-spherical in shape.

3. A mixed flow fan according to claim 1, in which at least a part of said shroud is frusto-spherical in shape.

4. A mixed flow fan according to claim 1, further comprising drive means for rotatably driving said one or more fluid impelling blades.

5. A mixed flow fan according to claim 4, in which said drive means is a motor.

6. A mixed flow fan according to claim 1 in which said hub abutting edge of each of said one or more fluid impelling blades is curved about the center of curvature with a radius substantially equal to $r_1$.

7. A mixed flow fan according to claim 6, in which at least part of said hub is frusto-spherical in shape.

8. A mixed flow fan according to claim 6, in which at least a part of said shroud is frusto-spherical in shape.

9. A mixed flow fan according to claim 6, further comprising drive means for rotatably driving said one or more fluid impelling blades.

10. A mixed flow fan according to claim 9, in which said drive means is a motor.

* * * * *

UNITED STATES PATENT AND TRADEMARK OFFICE

CERTIFICATE OF CORRECTION

PATENT NO. : 6,547,517 B1 
DATED : April 15, 2003
INVENTOR(S) : David Peter Fenner and Christopher Winston Lack It is certified that error appears in the above-identified patent and that said Letters Patent is hereby corrected as shown below:

Title page,
Item [75], Inventors, change first inventor's name and city from "David Peter-Fenner, Southhampton" to -- David Peter Fenner, Southampton --.

Signed and Sealed this

Fourth Day of November, 2003

JAMES E. ROGAN
*Director of the United States Patent and Trademark Office*